US006078254A

United States Patent [19]

Parker

[11] Patent Number: 6,078,254

[45] Date of Patent: Jun. 20, 2000

[54] SUSPENDED CODE FOR ALARM SYSTEM

[75] Inventor: James Parker, Thornhill, Canada

[73] Assignee: Digital Security Controls Ltd., Concord

[21] Appl. No.: 09/215,548

[22] Filed: Dec. 18, 1998

[51] Int. Cl.[7] ..... G08B 29/00

[52] U.S. Cl. ..... 340/514; 340/506; 340/527; 340/528; 340/825.31; 307/10.4

[58] Field of Search ..... 340/506, 507, 340/527, 528, 825.06, 825.3, 825.31, 825.32, 305.19; 307/10.4

[56] References Cited

U.S. PATENT DOCUMENTS 5,400,246 3/1995 Wilson et al. ..... 340/825.06 X 5,850,753 12/1998 Varma ..... 70/278

5,872,513 2/1999 Fitztgibbon et al. ..... 340/539

*Primary Examiner*—Daryl Pope

[57] ABSTRACT

The system generates alarm suspension codes without direct interaction with the alarm panel. The alarm control panel generates its own suspension codes for checking for proper validation when a suspension code is entered. The alarm panel generates suspension codes sequentially and will recognize any of several suspension codes that are current. The entry of a later suspension code cancels all earlier suspension codes.

7 Claims, 4 Drawing Sheets

SUSPENDED CODE FOR ALARM SYSTEM

FIELD OF THE INVENTION

The present invention relates to security systems and in particular, relates to temporary access codes to provide access to protected premises on a one time or temporary basis.

BACKGROUND OF THE INVENTION

There are certain requirements where it is desirable to provide a one time code to service or maintenance personnel to allow them access to a premise protected by a security system. It is often difficult to know the precise time when a service contractor will attend at the premises and it would be desirable to provide him with a code which will function, assuming it is used within a relatively short time basis.

In an attempt to deal with this situation, security systems have been known to provide limited access codes which are limited for a certain period of time during which entry to the premises can occur. As can be appreciated, once the desired work has been completed, there is no reason for the service contractor to need the code and the security system is somewhat compromised unless the code is removed. This takes some time and a certain follow-up discipline which is not always as complete as would be desirable. To overcome some of these problems, it is known not to arm the security system on a given day when service is to be completed, however, this defeats the purpose of the security system.

It is also desirable to have the capability to provide certain service contractors with a temporary code. It would be desirable to be able to accomplish this task without programming of the security system.

This problem of managing controlled access to certain premises is compounded with respect to condominium or associated housing developments where a manager often arranges for and essentially supervises the access of contractors to the various premises.

The present invention seeks to overcome a number of these difficulties.

SUMMARY OF THE INVENTION

A security system according to the present invention comprises an alarm panel having a plurality of sensors connecting terminals and a keypad for inputting codes to alter the status of the security system. The alarm panel includes an arrangement for generating temporary suspend codes for suspending the operation of the alarm system for a temporary period of time when the code is entered at the keypad. The generating arrangement generates a sequence of suspend codes in a predetermined manner and generates a plurality of next to be used suspend codes relative to the last suspend code used. The alarm panel includes an accepting arrangement which monitors the entry of suspend codes and only accepts the entry of the next to be used suspend code and appropriately suspends the operation of the alarm system in a predetermined manner.

According to an aspect of the invention, the generating arrangement upon acceptance of a suspend code generates a new plurality of next to be used suspend codes and cancels any previously generated suspend codes.

According to further aspect of the invention, the generating means includes a counter which counts the time from issue of a suspend code and cancels the suspend code after expiry of a predetermined period of time.

According to yet a further aspect of the invention, the security system is used in combination with a computer which generates for the user, the next to be used suspend codes. The computer includes the same generating arrangement as the alarm panel. The computer allows display of a limited part of the sequence of prior cancelled suspend codes and current suspend codes. Preferably, the computer is capable of displaying three to 10 suspend codes with one prior cancel suspend code being shown. The actual number of displayed suspend codes can vary and will depend upon the particular application.

According to yet a further aspect of the invention, the keypad includes a plurality of function keys which can be programmed and one of said function keys is programmed as a suspend code key. In this way, the alarm control panel distinguishes suspend codes from normal codes used to arm or disarm the security system.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
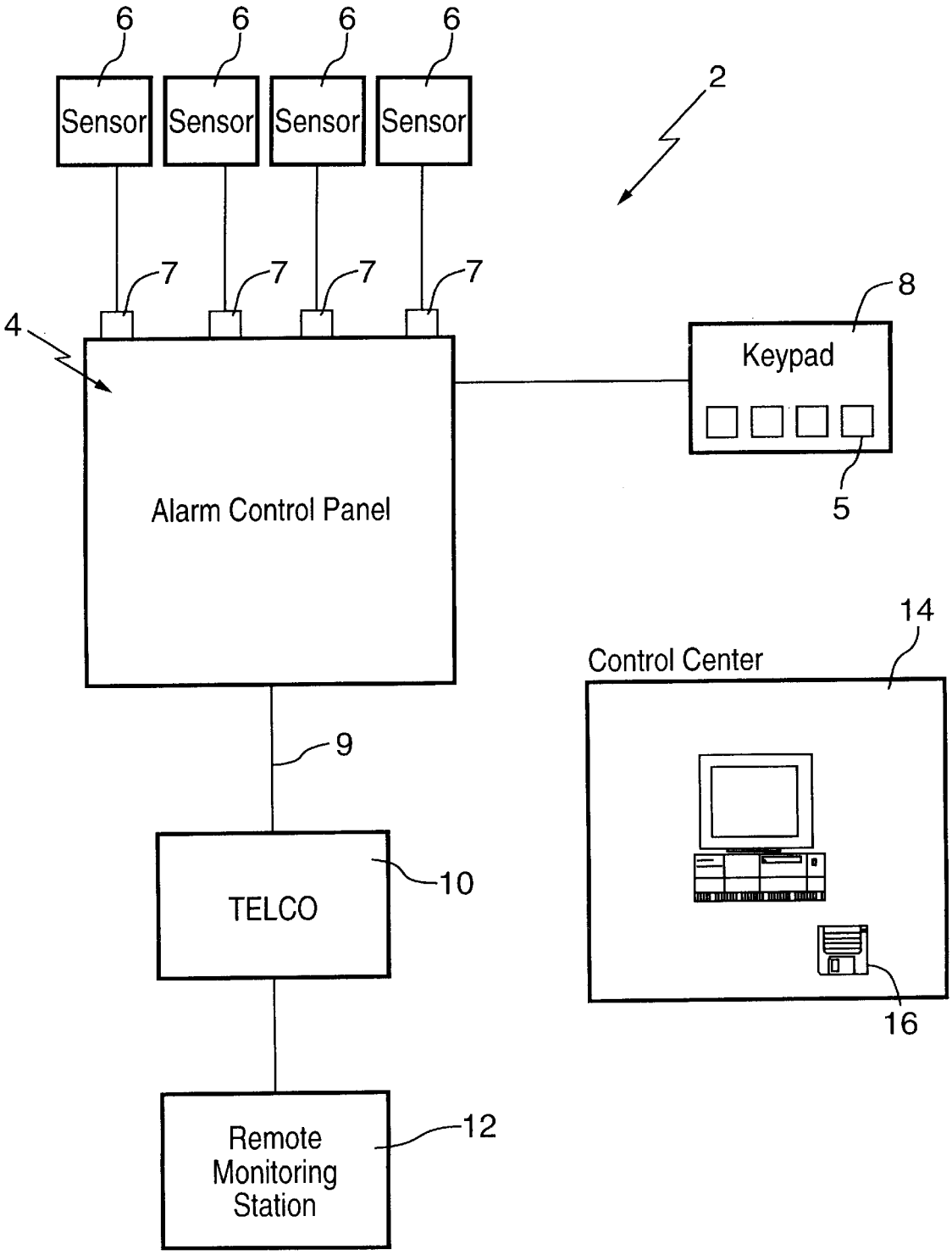
FIG. 1 is a block diagram of an alarm system of the present invention.

FIG. 1 shows a security system 2 which includes an alarm control panel 4, a plurality of sensors 6 connected to the alarm panel at terminals 7 provided on the alarm panel. The keypad 8 is associated with the alarm control panel for allowing a user to interact with the control panel. The control panel is connected by telephone line 9 to the local telephone company generally shown as 10 for placing telephone communications to the remote monitoring station 12. This general configuration of a security system is well known and quite common.

The keypad 8 includes numeric keys as well as a number of function keys 5 which can be programmed. One of these function keys 5 is programmed as a suspend code key.

Associated with the security system of FIG. 1 is a personal computer 14 programmed with software contained on the floppy disk 16 or in any other suitable manner. The personal computer is programmed to generate the same suspension codes as the suspension codes generated by the alarm control panel without the requirement for the personal computer to communicate with the security system. If the personal computer loses synchronization with the security system, there is a procedure to regain synchronization.

Figure 2:
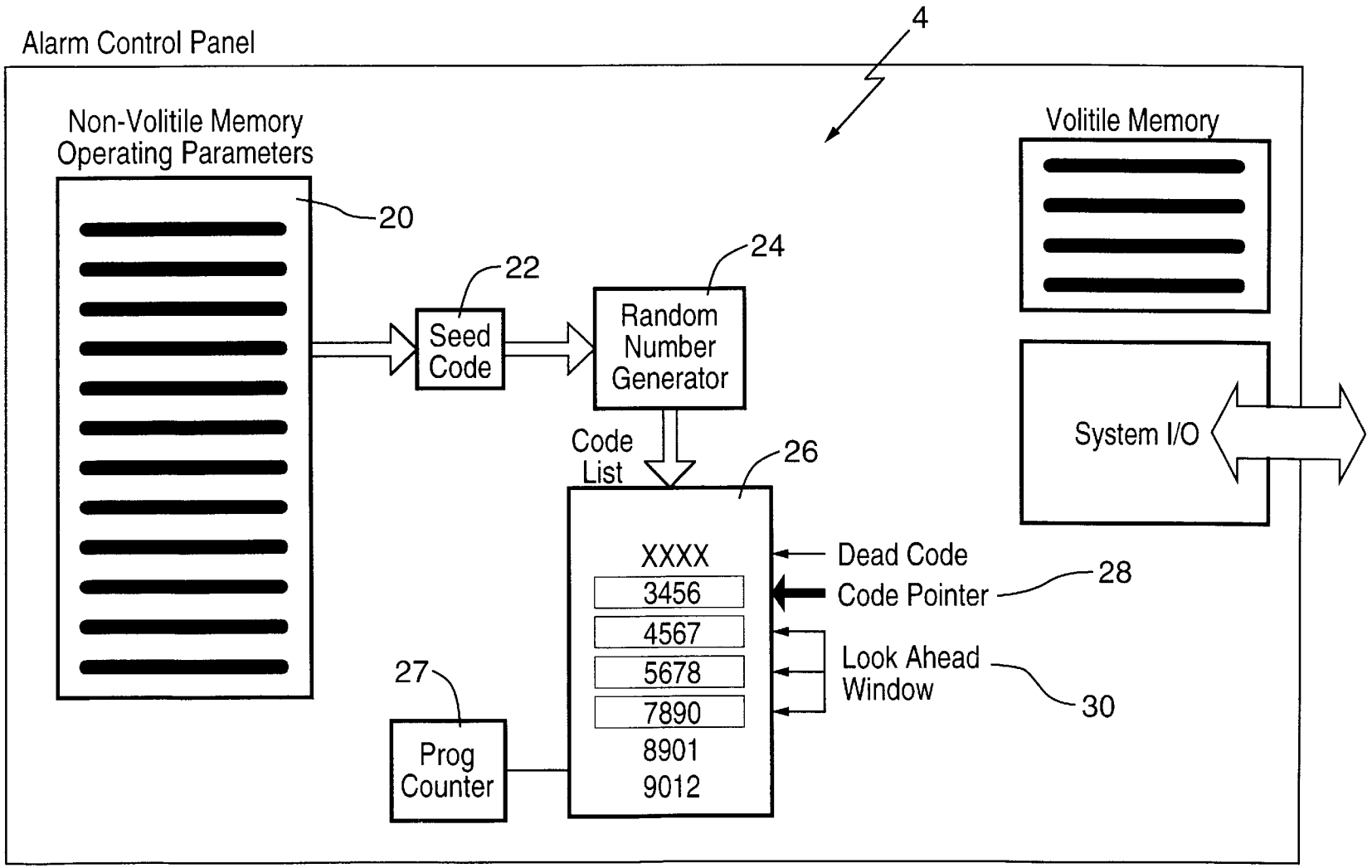
FIG. 2 is a block diagram of the alarm panel showing additional details.

FIG. 2 shows the additional features of the alarm control panel associated with the generation of suspension codes. Each alarm control panel is programmed with a seed code used to generate suspension codes. The alarm control panel is provided with a seed code at the time of manufacture and this seed code is associated with software for the PC used to generate corresponding codes. In this way, each alarm control panel and the PC software associated therewith, generate the same suspension codes. FIG. 2 shows the non volatile memory of the alarm control panel which includes the operating parameters thereof including the seed code 22. The alarm control panel includes a random number generator 24 which uses the seed code to generate a list of suspend codes generally shown as 26.

The list 26 includes a dead code shown by XXXX and a sequence of active codes. The first active code is 3456 and preferably, there are a number of "look ahead" codes; in this case, shown at 4567, 5678 and 7890. The alarm control panel includes a programmable counter 27 which is programmed to set a certain time duration for the suspension codes. For example, the control panel can set a time duration of one hour. This time period starts upon entry of a valid suspension code and expires one hour later. Appropriate time durations are set by the owner.

With the arrangement shown in FIG. 2, use of the maintenance key 5 followed by any of the codes 3456, 4567, 5678 or 7890 suspend the existing status of the security system and disarm the system, allowing the service person to gain access to the premises. A control person of the associated alarm monitoring station assigns these suspension codes to particular service contractors using the personal computer 14. The monitoring station is contacted and a control person activates the suspension code software from the computer, then enters information identifying the contractor and obtains a printout of the suspension code. The suspension code can then be communicated to the originating party.

Figure 3:
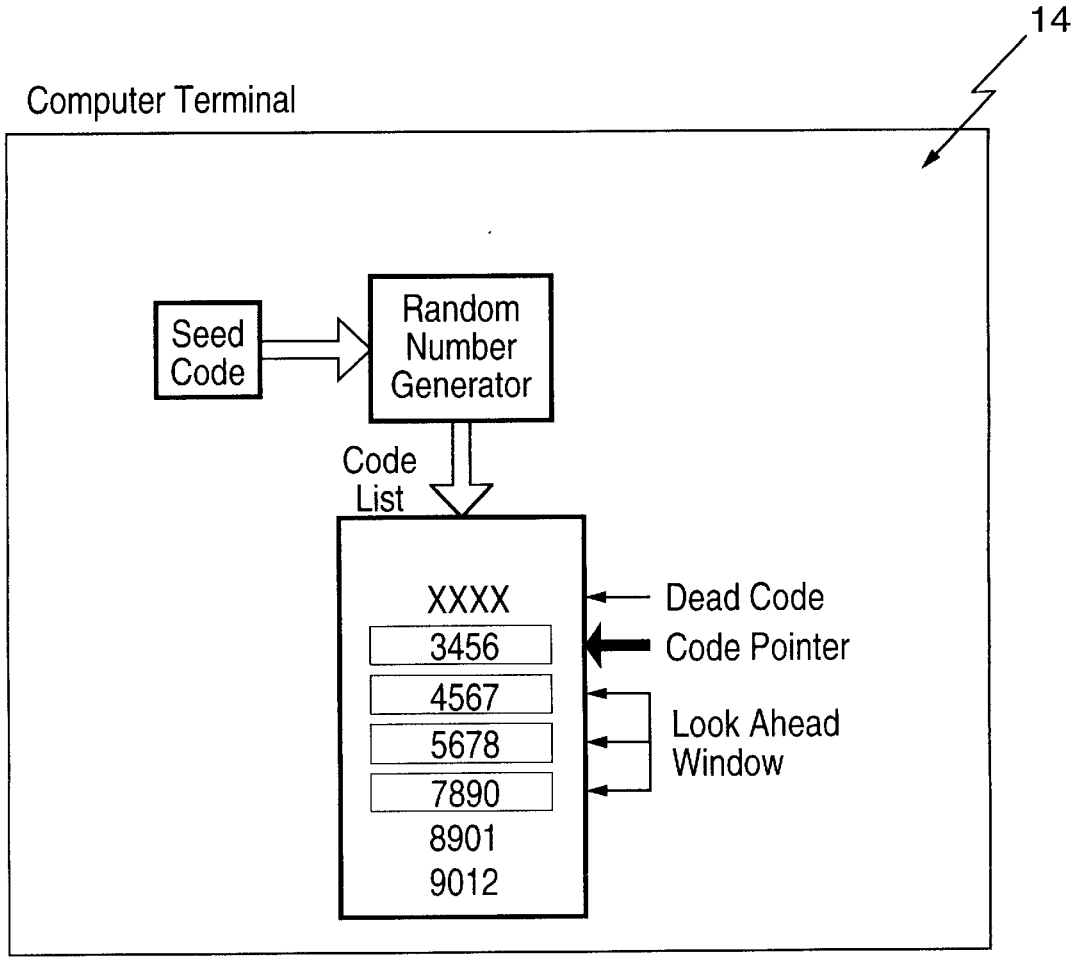
FIG. 3 is a block diagram of the computer terminal showing details of the suspend code generation.

As shown in FIG. 3, the personal computer has the same seed code and same random number generator as the alarm control panel. It also generates a code list and displays a limited number of suspend codes and in this case, four suspend codes are shown The control person, when required, will assign one of these suspend codes to a particular contractor to allow him on a one time basis, to gain entry to a particular location. The personal computer should be in sequence with the alarm control panel as they both start off with the same seed code and the same random number generator. The number of codes that have been assigned, should on a generally consistent basis, be the same as the codes that are being used by the service contractors to suspend the operation of the alarm control panel. By assigning the plurality of the codes or making a limited number of codes active, the personal computer and the alarm control panel should be kept in general synchronization. The personal computer upon assigning one code will generate the next code and show it in the look ahead window. Similarly, when any suspension code is entered in the alarm control panel and determined to be valid and subsequently expires, the alarm panel will cancel or invalidate all earlier codes. After the entered valid code has expired, based on the counter, the control panel will generate additional codes. If the last code in the look ahead number buffer or window is entered, the predetermined number of suspend codes will be generated. Typically, these codes can be provided to service contractors in a time order and the codes will be used in that timed order. If a later code is entered into the alarm control panel, the alarm control panel cancels all earlier codes. This arrangement helps to maintain synchronization and also serves to cancel suspend codes which were not used in a timely manner. It also forces service contractors to act in a timely manner, otherwise their temporary authorization may be superseded.

Figure 4:
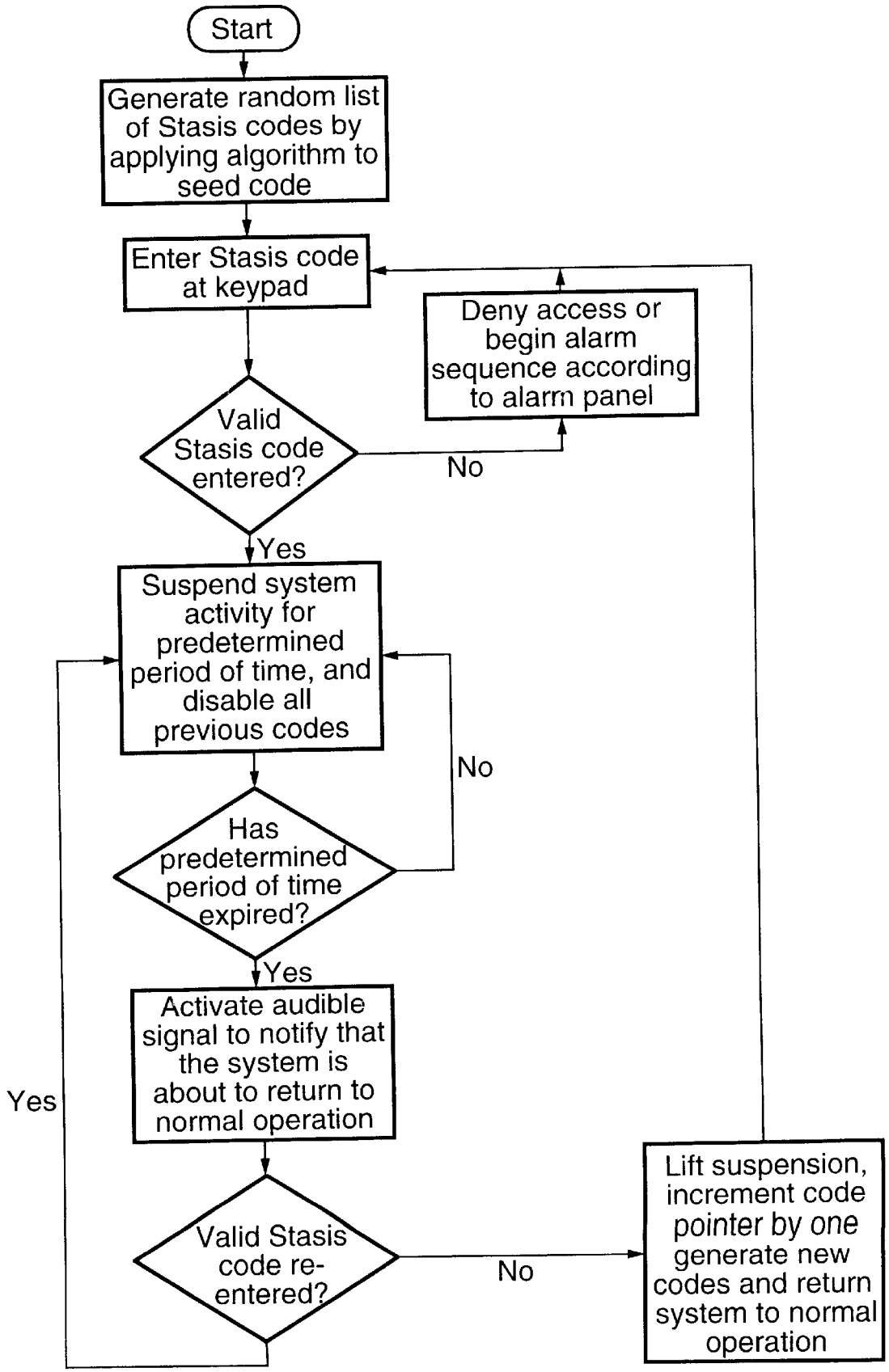
FIG. 4 is a flow chart showing certain steps used by the alarm control panel.

FIG. 4 shows the steps used by the control panel. The first step of the alarm control panel is to generate a random list of suspend codes by applying the algorithm to the seed code. Once this has been accomplished, the user can enter a suspend code at the keypad. The alarm control panel then makes an assessment whether the suspend code is valid. If the suspend code is valid, it suspends the system activity for a predetermined period of time, increments the code pointer by one after expiry of the predetermined time, and disables all previous codes. If the suspend code is not valid, i.e., it is not one of the active codes, then access is denied, and the alarm panel continues to proceed in its normal manner.

The present system allows improved control of an alarm control panel and also allows the operator of the personal computer to issue one time suspend codes. Typically, this operator is a control person at the alarm monitoring station although other arrangements are possible. The programmable counter permits the entry of a certain time period that the suspend code will be valid for. For example, once the suspend code has been entered, the alarm control panel will suspend the system for the period determined by the programmable counter. The period of time has a default valve set at the factory which can be changed by an installer. Once the period has expired, the keypad buzzer will sound a warning indicating that the system is about to return to its previous status. The service personnel can then leave. The panel will return to its original state once a warning enunciation has expired. If the system was disarmed, the system will remain disarmed. If the system would have experienced an automatic arming sequence, then the panel will automatically arm the system. If the system was armed to start with, it will return to the armed state.

If the PC software generator and the associated alarm panel are out of synchronization, a reset option is provided that restarts the code pointer to a known or determined point in of the stack. This option is controlled by downloading software associated with the monitoring station and the personal computer and requires communication with the alarm control panel or the entry of certain override commands.

With the present arrangement, direct interaction of the alarm control panel and the personal computer is generally avoided and approximate synchronization of the alarm panel and a suspension code generator is achieved. The arrangement also serves to invalidate suspension codes that were not used in a timely manner.

In addition, this arrangement also allows an authorized building manager to use a single computer for generating different suspension codes for different alarm control panels. This is very convenient and maintains each alarm system and the suspension codes thereof, independent of other alarm systems.

Although various preferred embodiments of the present invention have been described herein in detail, it will be appreciated by those skilled in the art, that variations may be made thereto without departing from the spirit of the invention or the scope of the appended claims.

What is claimed is:

1. A security system comprising an alarm panel, a plurality of sensor connecting terminals and a keypad for inputting codes to alter the status of the security system, said alarm panel including an arrangement for generating temporary suspend codes for suspending the operation of the alarm system for a temporary period of time when the code is entered at said keypad, said generating arrangement generating a sequence of said suspend codes in a predetermined manner and generates a plurality of next to be used suspend codes relative to the last suspend code used, said alarm panel including an accepting arrangement which monitors the entry of suspend codes and only accepts the entry of a suspend code included in said plurality of next to be used suspend codes and appropriately suspends the operation of the alarm system in a predetermined manner.

2. A security system as claimed in claim 1 wherein, said generating arrangement upon acceptance of a suspend code generates a new plurality of next to be used suspend codes and cancels any previously generated earlier suspend codes.

3. A security system as claimed in claim 2 wherein said generating arrangement includes a counter which counts the time from issue of a suspend code and cancels the suspend code after expiry of a predetermined period of time.

4. A security system as claimed in claim 2 in combination with a computer which generates for the user the next to be used suspend codes, said computer including the same generating arrangement, said computer also allows for display of a limited part of the sequence of prior cancelled suspend codes and the current suspend codes.

5. A security system as claimed in claim 4 wherein said computer displays up to 10 codes.

6. A security system as claimed in claim 4 wherein said computer displays one prior cancelled suspend code.

7. A security system as claimed in claim 1 wherein said keypad includes a number of function keys and one of said function keys is programmed as a suspend code key.

* * * * *